United States Patent [19]

Krawietz

[11] Patent Number: 4,959,953

[45] Date of Patent: Oct. 2, 1990

[54] FUNNEL FOR A SPINNING MACHINE

[75] Inventor: Stefan Krawietz, Ebersbach/Fils, Fed. Rep. of Germany

[73] Assignee: Zinser Textilmaschinen GmbH, Fed. Rep. of Germany

[21] Appl. No.: 277,858

[22] Filed: Nov. 30, 1988

[30] Foreign Application Priority Data

Dec. 8, 1987 [DE] Fed. Rep. of Germany ..... 3741432

[51] Int. Cl.[5] ..... D01H 7/18; D01H 1/06; D01H 1/42; D01H 7/66

[52] U.S. Cl. ..... 57/354; 57/67; 57/74; 57/115; 57/127

[58] Field of Search ..... 57/74, 67–71, 57/115–117, 127, 352–355

[56] References Cited

U.S. PATENT DOCUMENTS

| | | | |
|---|---|---|---|
| 775,549 | 11/1904 | Alexander et al. | 57/70 |
| 2,500,827 | 3/1950 | Ickringill | 57/115 |
| 4,437,300 | 3/1984 | Vignon | 57/67 X |
| 4,592,196 | 6/1986 | Wolf | 57/67 X |
| 4,779,409 | 10/1988 | Marchiori et al. | 57/354 |

FOREIGN PATENT DOCUMENTS

| | | | |
|---|---|---|---|
| 0225660 | 6/1987 | European Pat. Off. . | |
| 3400327 | 7/1985 | Fed. Rep. of Germany . | |
| 1029823 | 5/1966 | United Kingdom | 57/67 |
| 1030853 | 5/1966 | United Kingdom | 57/67 |
| 1080283 | 8/1967 | United Kingdom | 57/115 |

*Primary Examiner*—John Petrakes
*Attorney, Agent, or Firm*—Shefte, Pinckney & Sawyer

[57] ABSTRACT

A funnel for delivering yarn for building a package on a spindle of a spinning machine has an entry channel for the passage of yarn therethrough into the interior of the funnel and an exit opening for the passage of yarn therethrough from the interior to the exterior of the funnel, the interior of the funnel having a lateral extent sufficient to allow the formation of a yarn balloon of controlled extent during building of the package on the spindle. The funnel can contain a guide portion projecting interiorly of the funnel at a spacing from the entry channel and a neck portion in which the entry channel is formed.

4 Claims, 2 Drawing Sheets

FUNNEL FOR A SPINNING MACHINE

BACKGROUND OF THE INVENTION

The present invention relates to a funnel for a spinning machine. More particularly, the present invention relates to a funnel for guiding yarn onto a rotating spindle to form a package thereon.

One known phenomena which occurs during spinning on a ring spinning machine is the creation of a yarn balloon. For example, a yarn balloon can form between a yarn guide which guides yarn to a spindle through a traveler rotatable around the spindle. The formation of balloons is one reason why the spinning speed must be limited. For example, the balloon will detrimentally create some wind resistance as well as exert a centrifugal force.

In German Patent A 34 00 327, a funnel for a spinning machine is disclosed which completely suppresses the formation of yarn balloons. The patent discloses regulating the differences occurring in the winding speed, and thus, the yarn tension, by controlling the travel of the yarn over the surface of the funnel. The increase in the rate of travel of the yarn over the surface of the funnel is dependent upon the yarn tension. However, the yarn tension relative to the entire ring spinning machine is relatively small.

SUMMARY OF THE INVENTION

The present invention provides an apparatus which improves the conditions in which self-actuated regulation of the yarn tension will occur.

The present invention provides an apparatus for realizing the benefits of yarn balloons without incurring the disadvantage of these balloons. Since the yarn balloon formed in accordance with the present invention rotates inside the funnel, the balloon is of controlled size and offers virtually no significant air resistance. In accordance with the present invention, the air inside of the funnel of the present invention can be rotated with the yarn so that substantially no relative movement between the yarn balloon and the funnel occurs. Additionally, the yarn balloon formed in accordance with the present invention is relatively small so that the centrifugal forces occurring during high rates of travel of the yarn can be effectively handled.

The present invention provides, in an apparatus for delivering yarn for building a package on a spindle of a spinning machine, a funnel including an entry channel for the passage of yarn therethrough into the interior of the funnel and an exit opening for the passage of yarn therethrough from the interior to the exterior of the funnel, the interior of the funnel having a lateral extent sufficient to allow the formation of a yarn balloon of controlled extent during building of the package on the spindle. Preferably, the exit opening is longitudinally spaced from the opening of the entry channel into the interior of the funnel.

In one modification of the funnel of the present invention, a guide portion is provided on the funnel communicating with the exit opening and projecting interiorly of the funnel at a spacing from the entry channel, the guide portion being adjustable to adjust the spacing between the guide portion and the entry channel.

In another modification of the funnel of the present invention, the funnel has a neck portion in which the entry channel is formed. Preferably, the neck portion is adjustable to adjust the spacing between the exit opening and the entry channel.

DETAILED DESCRIPTION OF THE PREFERRED EMBODIMENTS

Figure 1:
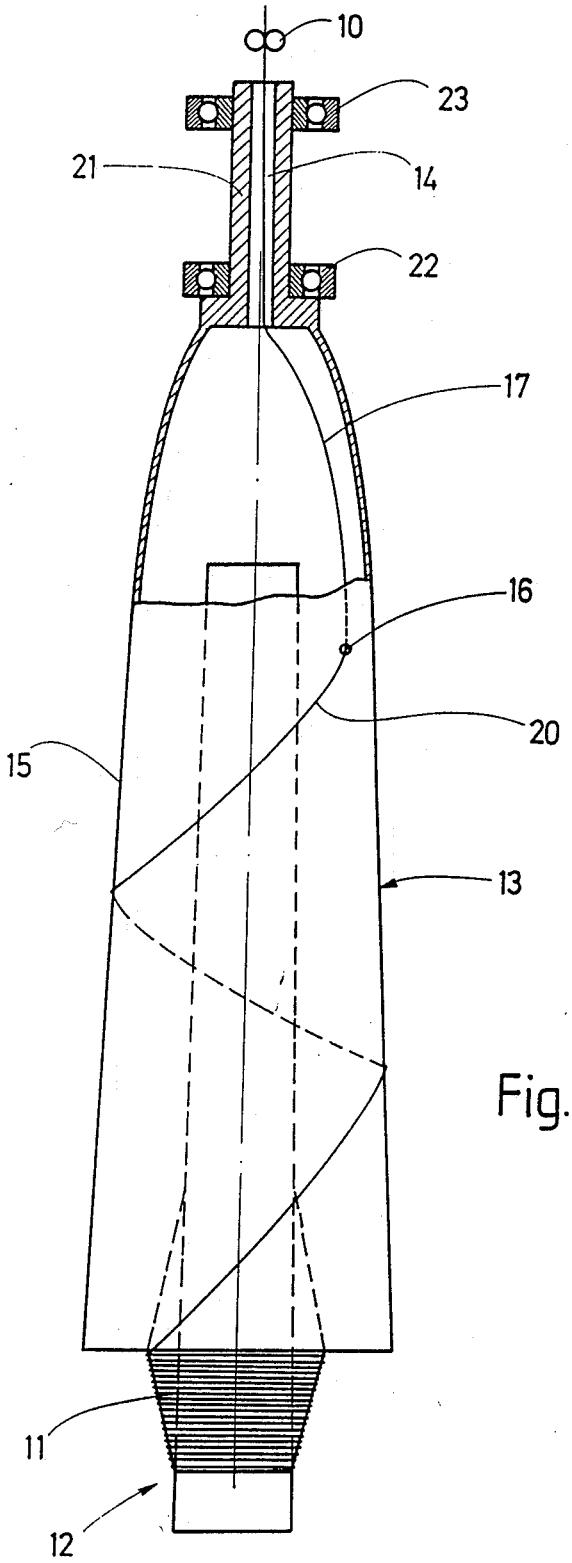
FIG. 1 is a front elevational view in partial vertical section of the funnel of one preferred embodiment of the present invention.

In FIG. 1, one preferred embodiment of the present invention is illustrated for use with yarn which is delivered through a pair of delivery rollers 10 to a funnel 13 from which the yarn is wound onto a package 11 on a spindle 12. The yarn 20 travels from the delivery rollers 10 through an entry channel 14 in the funnel 13 to the inside of the funnel and exits through an exit opening 16 to the outside surface 15 of the funnel. The yarn 20 travels in a spiral-like manner about the outside surface 15 of the funnel 13 as it is wound onto the package 11. The funnel 13 is rotatably mounted to the spinning machine by means of a pair of spaced bearings 22, 23 cooperatively engaging a neck portion 21 of the funnel 13 in which the entry channel 14 is located.

During its travel through the interior of the funnel, the yarn 20 extends from the interior open end of the entry channel 14 to the exit opening 16 and this region of the interior of the funnel is constructed with sufficient lateral extent, with respect to the axis of the funnel, that a balloon 17 forms during spinning of the yarn 20 sufficient to accommodate accelerations and decelerations of the yarn 20 during the building of the package 11 on the spindle 12. The size of the balloon 17—that is, the extent of the deviation of the yarn forming the balloon from a straight line connecting the interior end of the entry channel 14 and the exit opening 16—is dependent upon the axial position of the opening 16 with respect to the end of the entry channel 14 and the rate of rotation of the funnel 13. In one modification of the preferred embodiment of the present invention, the funnel 13 is provided with a plurality of openings 16, each in a different axial position with respect to the interior open end of the entry channel 14.

Figure 2:
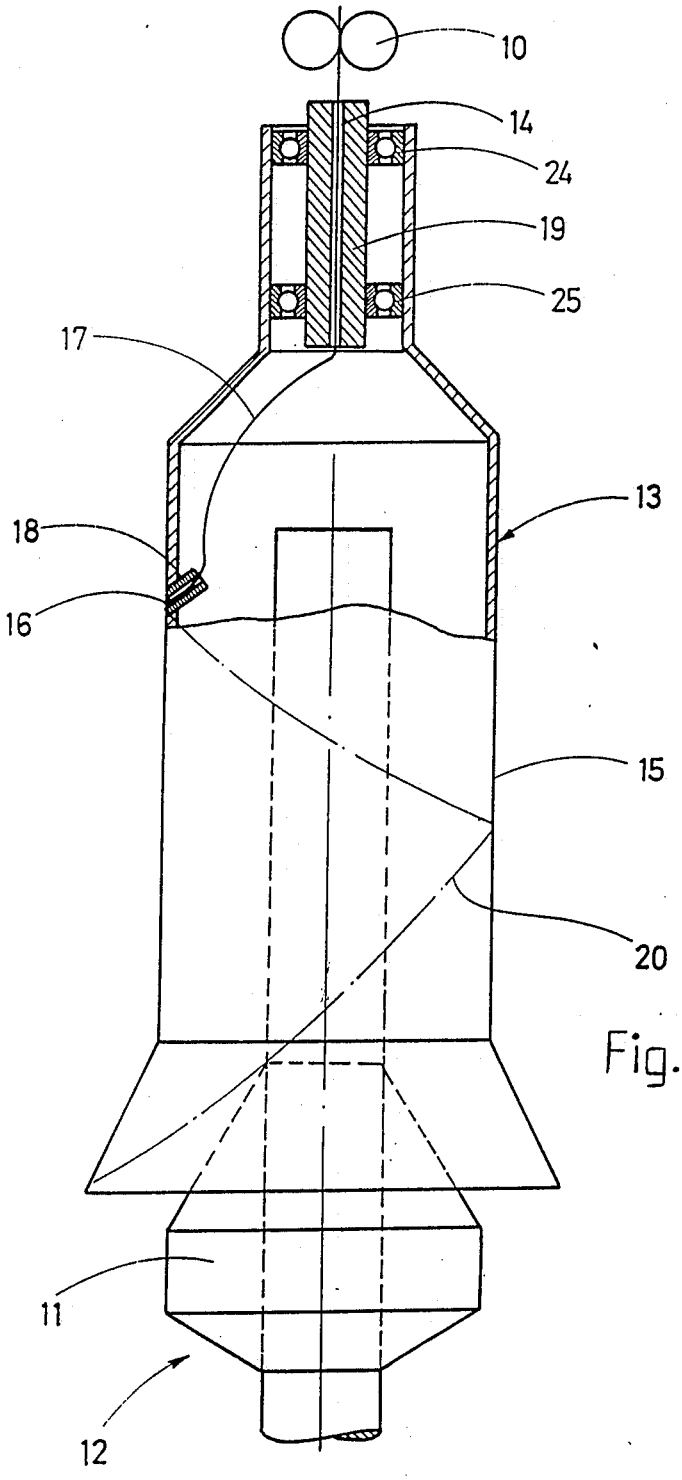
FIG. 2 is a front elevational view in partial vertical section of a funnel of another embodiment of the present invention.

In FIG. 2, another embodiment of the present invention is illustrated and includes a funnel 13 having an entry channel 14 in which yarn 20 delivered through a pair of rollers 10 passes into the interior of the funnel and exits through an exit opening 16 in the funnel to the outer surface 15 of the funnel to be wound onto a package 11 on a spindle 12. The entry channel 14 is formed in a neck portion 19 which is rotatably supported within the upper axial end of the funnel 13 by a pair of bearing assemblies 24, 25. The funnel 13 is mounted in a fixed position with respect to the rollers 10.

A tubular guide portion 18 is communicated with the exit opening 16 and projects into the interior of the funnel 13. The end of the guide portion 18 distal from the exit opening 16 and the axial end of the entry channel in the neck portion 19 opening into the interior of the funnel 13 are positioned relative to one another such that a balloon 17 of the yarn 20 forms during spinning. The guide portion 18 insures that the balloon 17 is sufficiently inwardly spaced from the inner surface of the funnel 13 that the balloon does not contact the inner surface. The radial distance between the distal end of the guide portion 18 and the axis of the funnel 13 is one factor which influences the circumferential speed of the balloon 17. In this respect, the embodiment illustrated in FIG. 2 may utilize a guide portion 18 which is adjustable along its length or is exchangeable for another guide portion of a different length, so that the radial distance between the distal end of the guide portion 18 and the axis of the funnel 13 can be varied.

In the modification of the embodiment illustrated in FIG. 2, the upper end of the funnel 13 is supported by bearings on the neck portion 19 permitting a range of selective relative positioning of the neck portion 19 and the funnel 13 axially with respect to one another whereby the neck portion 19 is axially adjustable with respect to the funnel 13 so that the axial position of the axial end of the neck portion 19 with respect to the exit opening 16 and guide portion 18 can be varied.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In an apparatus for delivering yarn for building a package on a spindle of a spinning machine, a funnel comprising:

a neck portion defining a yarn entry channel and a coaxial annular funnel body portion defining an open interior area communicating at one end of said funnel body portion with said entry channel of said neck portion and open at the opposite end of said funnel body portion for receiving said spindle, said funnel body portion defining a yarn exit opening at an axial spacing from said entry channel of said neck portion and having an exterior yarn guide surface extending axially from said yarn exit opening to said opposite end of said funnel body portion, said yarn entry channel of said neck portion being adapted for delivering yarn into said interior area of said funnel body portion and said exit opening of said funnel body portion being adapted for passage of yarn from said interior area of said funnel body portion to said exterior yarn guide surface thereof, said yarn entry channel being of a sufficiently constricted cross-section for the passage of yarn therethrough in a substantially longitudinal path into said interior area of said funnel body portion, said interior area of said funnel body portion being of a sufficiently enlarged cross-section in relation to said entry channel of said neck portion and in relation to said spindle and said exit opening of said funnel body portion being sufficiently spaced from said yarn entry channel of said neck portion for causing yarn to balloon while traveling within said interior area of said funnel body portion between said entry channel of said neck portion and said exit opening of said funnel body portion, the cross-section of said interior area of said funnel body portion controlling the amount of yarn ballooning.

2. In an apparatus for delivering yarn for building a package on a spindle of a spinning machine, a funnel according to claim 1 and characterized further by a guide portion on said funnel and communicating with said exit opening for passage of yarn from the interior of said funnel through said guide portion and said exit opening, said guide portion projecting interiorly of said funnel at a spacing from said entry channel.

3. In an apparatus for delivering yarn for building a package on a spindle of a spinning machine, a funnel according to claim 2 and characterized further in that said guide portion is adjustable to adjust the spacing between said guide portion and said entry channel.

4. In an apparatus for delivering yarn for building a package on a spindle of a spinning machine, a funnel according to claim 1 and characterized further in that said neck portion and said funnel body portion are axially adjustable relative to one another to adjust the spacing between said exit opening and said entry channel.

* * * * *